US006640343B2

(12) United States Patent
Peters

(10) Patent No.: US 6,640,343 B2
(45) Date of Patent: Nov. 4, 2003

(54) DEACTIVATABLE HOOK AND LOOP FASTENER

(76) Inventor: Peter Peters, Buchengasse 66/23, A-1100 Wien (AT)

( * ) Notice: Subject to any disclaimer, the term of this patent is extended or adjusted under 35 U.S.C. 154(b) by 0 days.

(21) Appl. No.: 10/038,595

(22) Filed: Jan. 2, 2002

(65) Prior Publication Data

US 2002/0108167 A1 Aug. 15, 2002

(30) Foreign Application Priority Data

Jan. 3, 2001 (AT) ..... 8/2001

(51) Int. Cl.[7] ..... A41D 27/20
(52) U.S. Cl. ..... 2/247
(58) Field of Search ..... 2/247, 251, 252, 2/253, 920, 912, 94, 93, 85, 108; 24/442, 306, 450; 224/645, 650, 652, 655, 658

(56) References Cited

U.S. PATENT DOCUMENTS

| | | | | | |
|---|---|---|---|---|---|
| 1,445,117 | A | * | 2/1923 | Vilinsky | 2/247 |
| 1,485,567 | A | * | 3/1924 | Roberts | 2/247 |
| 3,537,108 | A | * | 11/1970 | Daniels | 2/252 |
| 4,261,059 | A | | 4/1981 | Spitz | |
| 5,924,133 | A | | 7/1999 | Zapiti | |

FOREIGN PATENT DOCUMENTS

| | | |
|---|---|---|
| FR | 2188972 | 2/1974 |

* cited by examiner

*Primary Examiner*—Gloria M. Hale
(74) *Attorney, Agent, or Firm*—Reed Smith LLP

(57) ABSTRACT

A hook and loop fastener is disclosed for the pockets of articles and clothing such as coats, shirts and blouses comprising a hook fastener part, a loop fastener part and a deactivation flap which is attached to an article of clothing for being inserted between the hook fastener part and the loop fastener part.

2 Claims, 2 Drawing Sheets

DEACTIVATABLE HOOK AND LOOP FASTENER

CROSS-REFERENCE TO RELATED APPLICATIONS

This application claims priority of Austrian Application A8/2001, filed Jan. 3, 2001, the complete disclosure of which is hereby incorporated by reference.

BACKGROUND OF THE INVENTION a) Field of the Invention

The invention is directed to a hook and loop fastener of a known type, particularly for the pockets of articles of clothing such as coats, jackets, shirts and blouses.

b) Description of the Related Art

Hook and loop fasteners of the known type are often used in place of zipper fasteners, buttons, and so on: e.g., U.S. Pat. No. 4,261,059 A (Louis Spitz), Apr. 14, 1981 in connection with a jacket comprising removable sleeves, or U.S. Pat. No. 5,924,133 A (Zapiti), Jul. 20, 1999 where buttons and zipper fasteners on articles of clothing are replaced by hook and loop fasteners. In FR 2,188,972 A (Turri), Feb. 22, 1974 , the problem of deactivating and adjusting hook and loop fasteners, especially in sports clothing, is solved by the arrangement of hook and loop fastener strips and by the use of a plurality of hook and loop fastener strips. This is either ineffective or is complicated, particularly in pockets of articles of clothing such as coats, jackets, shirts and blouses.

Hook and loop fasteners of the known type always close upon contact. This is not always desirable, especially in pockets of articles of clothing such as shirts, jackets, coats and blouses.

OBJECT AND SUMMARY OF THE INVENTION

The primary object of the invention is to enable temporary deactivation of these automatic fastener mechanisms in a simple manner. This object is met by the features contained in the characterizing part of the [claim] invention.

In accordance with the invention, a hook and loop fastener, particularly for the pockets of articles of clothing such as coats, jackets, shirts and blouses, comprising a hook fastener part, a loop fastener part and a deactivation flap which is attached to an article of clothing for being inserted between the hook fastener part and the loop fastener part.

DESCRIPTION OF THE PREFERRED EMBODIMENTS

The subject matter of the invention is a hook and loop fastener of a known type which is preferably arranged on the inside of pockets of articles of clothing, wherein a flap is provided, as is known in pockets of jackets, shirts, coats and blouses, but which serves specifically to deactivate and activate the hook and loop fastener. The deactivation flap is inserted into the pocket, that is, between the two components of the hook and loop fastener, in order to deactivate the hook and loop fastener, and is flipped outside in order to reactivate the hook and loop fastener.

Figure 1:
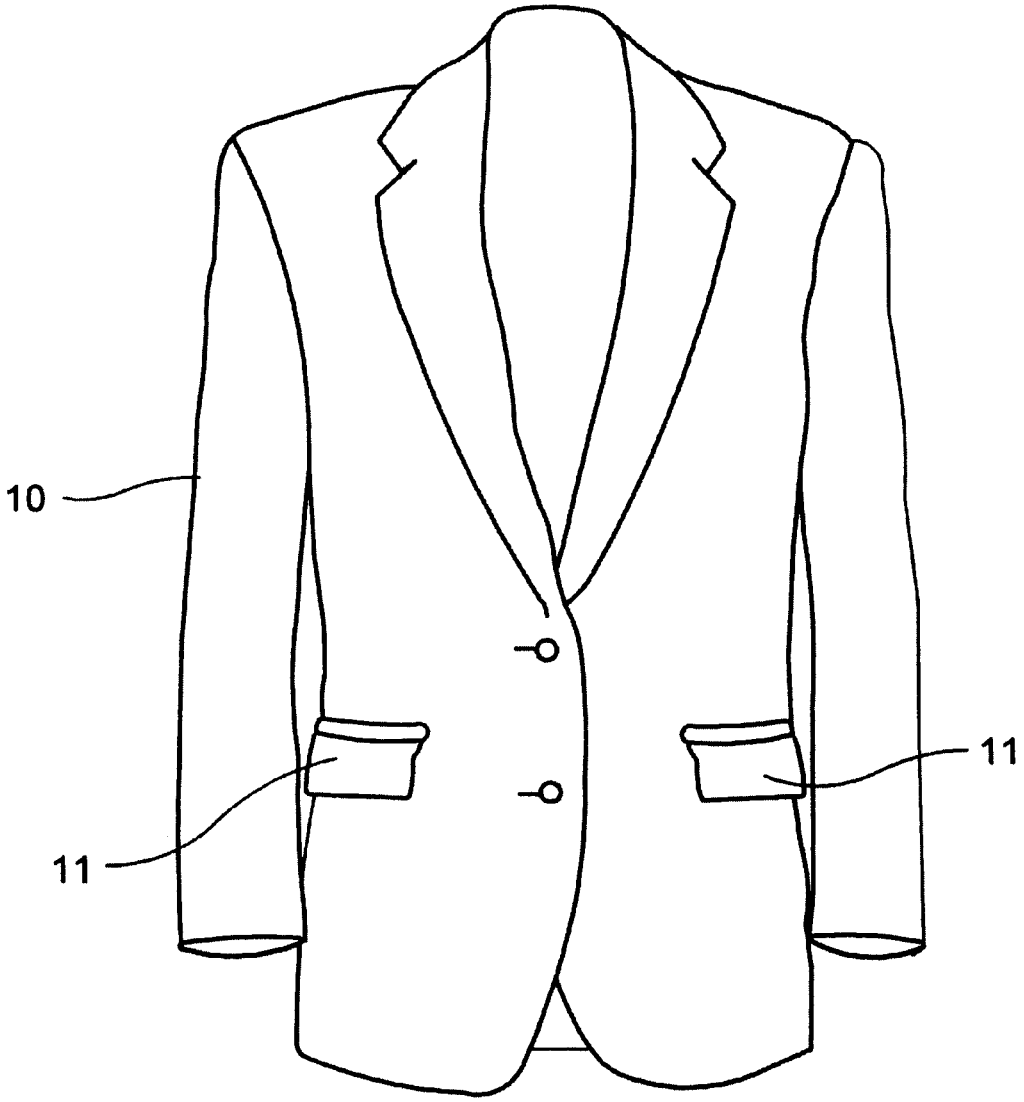
FIG. 1 shows a front view of an article of clothing having turned out flap pockets which may incorporate fasteners in accordance with the invention.

Referring to the drawings, an article of clothing 10 is shown in FIG. 1 with flap pockets 11, where the flaps are turned out, the two hook and loop fasteners are arranged in the area of the opening contact one another, and the pockets are held closed.

Figure 2A:
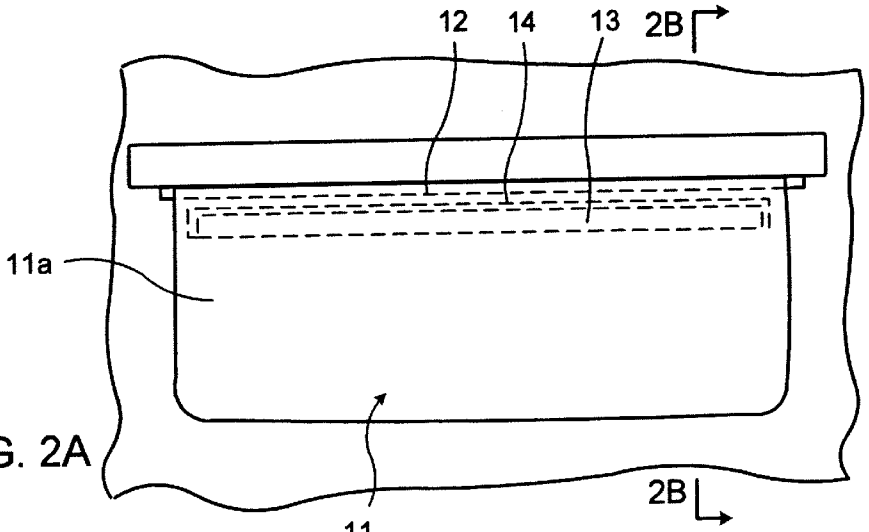
FIG. 2A is an enlarged front view of a turned out flap pocket incorporating a hook and loop fastener in accordance with the invention.
Figure 2B:
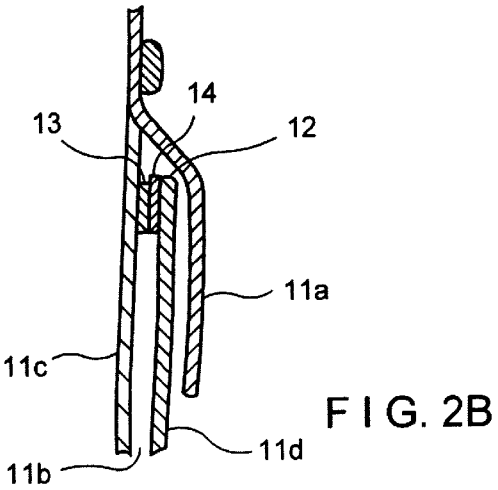
FIG. 2B is a sectional view along 2B—2B of FIG. 2A.

This is shown more clearly in FIG. 2A and FIG. 2B. FIG. 2A shows an enlarged view of a pocket flap 11*a* where the flap is turned out. The hook and loop fastener parts 13 and 14 are indicated by dashed lines and contact one another, and the flap pocket 11 is held closed.

In the sectional view 2B—2B in FIG. 2B, it is seen that one part of the hook and loop fastener 14 is attached to the inner side of the outer wall 11*d* of pocket 11*b*. The inner wall 11*c* has the other part 13 of the hook and loop fastener attached to it. The two parts of the hook and loop fastener are allowed to contact each other which keeps the pocket closed.

Figure 3A:
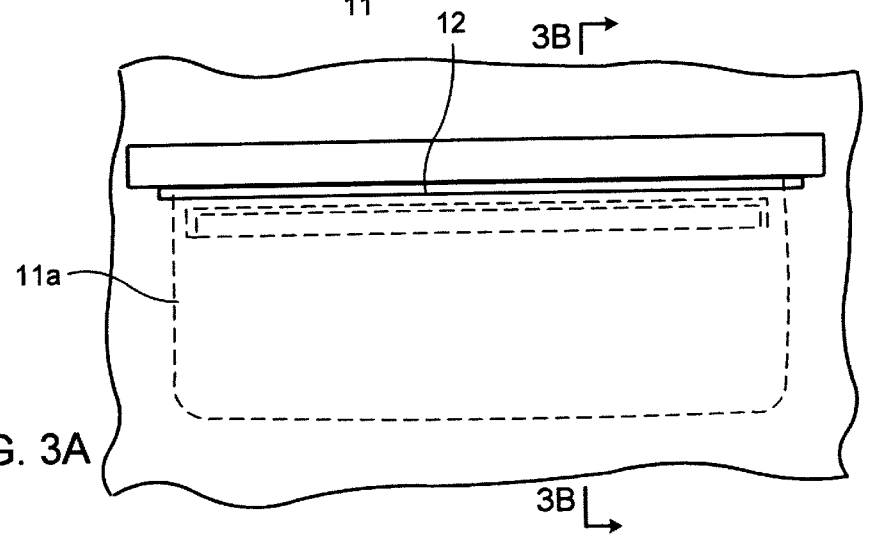
FIG. 3A is an enlarged front view of a turned in flap pocket incorporating the hook and loop fastener of the invention.

Referring now to FIG. 3A, here the flap 11*a* (indicated in dashes) is turned in and is therefore located between the hook and loop parts (once again in dashes) and the pocket is held open.

Figure 3B:
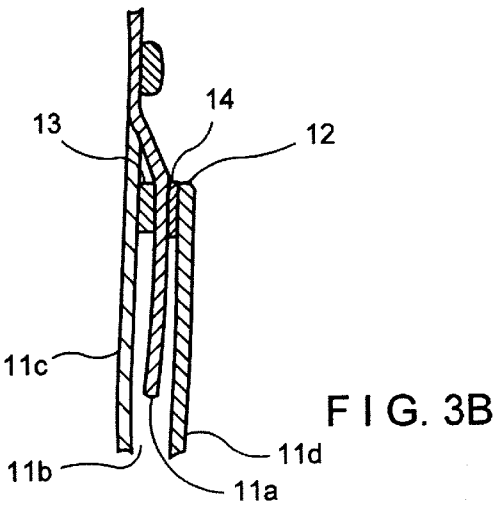
FIG. 3B is a sectional view along 3B—3B of FIG. 3A.

The sectional view 3B—3B in FIG. 3B shows that the flap 11*a* is inserted between the two components 13 and 14 of the hook and loop fastener. This keeps the outer wall of the pocket 11*d* to remain open.

While the foregoing description and drawings represent the present invention, it will be obvious to those skilled in the art that various changes may be made therein without departing from the true spirit and scope of the present invention.

What is claimed is:

1. A hook and loop fastener and a pocket construction combination for articles of clothing such as coats, jackets, shirts and blouses comprising:

a hook fastener part;

a loop fastener part; and a pocket construction having a deactivation flap attached to an article of clothing and structured for insertion between the hook fastener part and the loop fastener part to deactivate the hook fastener part from the loop fastener part.

2. A pocket control apparatus comprising:

a garment layer;

a pocket panel attached to the garment layer to form a pocket;

a first hook or loop component located on the garment layer;

a second hook or loop component located on an inside of the pocket panel for mating with the first hook or loop component;

a pocket deactivation flap attached to the garment layer at location above a top edge of the pocket panel wherein the deactivation flap lies over the pocket panel when the first and second hook and loop components are fastened or wherein the deactivation flap is placed between the first and second hook and loop fastener components in a deactivated or unfastened condition.

* * * * *